US005119576A

United States Patent [19]

Erning

[11] Patent Number: 5,119,576

[45] Date of Patent: Jun. 9, 1992

[54] FIREARM WITH SEPARABLE RADIATION EMITTING ATTACHMENT

[76] Inventor: Torsten Erning, Eschstr. 67, D-4424 Stadtlohn, Fed. Rep. of Germany

[21] Appl. No.: 589,336

[22] Filed: Sep. 27, 1990

[30] Foreign Application Priority Data

Jun. 6, 1989 [DE] Fed. Rep. of Germany ..... 3918357

[51] Int. Cl.[5] ..... F41A 33/02

[52] U.S. Cl. ..... 42/103; 273/310; 362/111

[58] Field of Search ..... 42/103; 273/310; 454/21; 33/234; 362/111

[56] References Cited

U.S. PATENT DOCUMENTS

| | | | |
|---|---|---|---|
| 1,451,294 | 4/1923 | Alexandre | 362/111 |
| 2,894,116 | 7/1959 | Koskey | 362/111 |
| 2,894,117 | 7/1959 | Koskey | 362/111 |
| 3,364,345 | 1/1968 | Davis | 362/111 |
| 3,510,965 | 5/1970 | Rhea | 42/103 |
| 3,655,192 | 4/1972 | Hall et al. | 362/111 |
| 3,782,832 | 1/1974 | Hacskaylo | 33/234 |
| 3,898,747 | 8/1975 | Marshall | 42/103 |
| 3,938,262 | 2/1976 | Dye et al. | 42/103 |
| 4,102,059 | 7/1978 | Kimble et al. | 273/310 |
| 4,117,282 | 9/1978 | Ieda | 42/103 |
| 4,367,516 | 1/1983 | Jacob | 434/21 |

FOREIGN PATENT DOCUMENTS

| | | | |
|---|---|---|---|
| 0262543 | 9/1987 | European Pat. Off. . | |
| 3337378 | 5/1985 | Fed. Rep. of Germany | 434/21 |
| 813643 | 6/1989 | Fed. Rep. of Germany . | |
| 1389406 | 12/1961 | France . | |

*Primary Examiner*—Michael J. Carone
*Attorney, Agent, or Firm*—Peter K. Kontler

[57] ABSTRACT

A long or short firearm wherein an essential part for the firing of ammunition can be disconnected from the housing to be replaced with an attachment which carries a laser. The laser is operated to emit a beam of radiation against a selected target in response to depression of the trigger which is carried by the housing. A circuit is provided to determine the duration of emission of radiation in response to depression of the trigger. The energy source or sources for the laser can be confined in the magazine of the housing and/or in the attachment. A sight on the attachment assumes the same position with reference to the housing as a sight of the detachable essential part when the attachment is connected to the housing in lieu of the essential part. The essential part can include the barrel and the firing chamber of a short firearm or the bolt action of a long firearm.

15 Claims, 2 Drawing Sheets

FIREARM WITH SEPARABLE RADIATION EMITTING ATTACHMENT

BACKGROUND OF THE INVENTION

The invention relates to firearms in general, and more particularly to improvements in convertible firearms.

It is already known to provide a short firearm with a barrel which is detachable from the grip together with one or more additional parts. The thus detached unit including the barrel and one or more additional parts can be replaced with an attachment which enables the user of the firearm to fire smaller-caliber ammunition which is often much less expensive than larger-caliber cartridges of the type to be used when the attachment is replaced with the aforementioned unit. This is particularly desirable when the unit is designed to accept large-caliber cartridges or shells, depending upon the nature of the firearm. Thus, when the firearm is ready for use, the unit is properly attached to the grip. Howewever, if the user (e.g., a person who must be highly skilled in the use of firearms because of her or his occupation or a sportsman or another firearms enthusiast) decides to use the weapon at a firing range, the unit is replaced with the attachment so that practicing with the thus converted firearm is much less expensive than the practicing which involves the firing of large-caliber ammunition.

A drawback of the aforedescribed convertible firearms is that they can be used only at a firing range. The reason is that the authorities consider the firearm a dangerous weapon irrespective of whether the grip carries the aforementioned unit or the attachment for use with smaller-caliber ammunition. Thus, even for the purpose of practicing, such weapons can be used only at a firing range which is often inconvenient because of the distance from home or from the place of business as well as because the person desiring to practice must observe the times of the day when the firing range is open for business.

It is further known to employ laser cartridges which are designed to emit a beam of radiation when struck by the hammer of a firearm. Such laser cartridges can be inserted into the firing chamber of a standard firearm by using an adapter which renders it possible to insert a laser cartridge in lieu of a larger-caliber cartridge. Reference may be had, for example, to German Utility Model No. G 88 13 643. Thus, the user of the firearm can greatly reduce the costs of practicing with the firearm by the simple expedient of inserting the adapter so that a standard firearm is converted for use with laser cartridges. However, and since the firearm remains fully operative for use as a dangerous weapon, i.e., because no essential parts are removed for the purpose of preventing the use of live ammunition, such firearms can be used only at firing ranges irrespective of whether or not the adapter is in place to ensure that the firearm can accept laser cartridges.

It is further known to provide specially designed practicing apparatus which resemble short firearms but are designed exclusively for emission of radiation. Reference may be had, for example, to published European patent application No. 0 262 543. When the apparatus is designed to emit invisible laser beams, it is necessary to employ specially designed targets in order to enable the user to ascertain the locus of impingement of the emitted beam upon the target. Such targets are often available at firing ranges but not at homes. Therefore, it was already proposed to employ a laser which emits a visible beam so that the trajectory of the emitted beam can be followed by the eyes of the person using the apparatus. Such apparatus can be used at home, in an office or elsewhere away from a firing range. A drawback of the just described apparatus is that many of their characteristics depart from those of a genuine firearm so that a person practicing with the apparatus is not ready to compete with or otherwise use a firearm which accepts live ammunition. For example, the center of gravity, the weight, the locus of the trigger and/or other characteristics of an apparatus which emits laser beams can greatly depart from the corresponding characteristics of a firearm which is to be used by the person practicing with the apparatus. Therefore, a person who has used the radiation emitting apparatus is not properly prepared to use a short or long firearm which merely, bears a certain resemblance to the apparatus.

OBJECTS OF THE INVENTION

An object of the invention is to provide a convertible firearm which is constructed and assembled in such a way that it can be rapidly converted from a genuine firearm (capable of firing live ammunition) into an apparatus ready for use as a practicing device which merely resembles but renders the impression of being identical with the genuine firearm.

Another object of the invention is to provide a short or long firearm which can be used at home, in an office or elsewhere away from a firing range as soon as it is converted for emission of radiation in lieu of firing bullets or other projectiles.

A further object of the invention is to provide a novel and improved attachment for use in or with the above outlined firearm.

An additional object of the invention is to provide a firearm the characteristics of which do not change when it is converted for use as a practicing apparatus or for use as a genuine weapon.

Still another object of the invention is to provide a convertible long or short firearm which can fire bullets or emit radiation so that it does not qualify as a dangerous weapon when used with the above outlined attachment.

An additional object of the invention is to provide a firearm which cannot be used as a weapon when it is ready to emit beams of radiation.

SUMMARY OF THE INVENTION

The invention is embodied in a firearm which comprises a housing, an ammunition (such as cartridges or shells) receiving firing chamber which is detachably connected with the housing, a trigger which is carried by the housing and is actuatable to initiate the discharge of ammunition in the chamber, and an attachment which is connectable with the housing in lieu of the firing chamber and comprises a laser which is operable to emit a beam of radiation and means for operating the laser in response to actuation of the trigger when the attachment is connected with the housing in lieu of the firing chamber so that ammunition can be discharged in response to actuation of the trigger only when the attachment is disconnected from and the firing chamber is connected to the housing.

The firearm further comprises a hammer which serves to strike the ammunition in the firing chamber in response to actuation of the trigger. The attachment preferably includes a sensor (such as a pressure-responsive sensor) which is actuatable to complete the circuit of (i.e., to energize) the laser (so that the laser emits a beam of radiation) upon connection of the attachment to the housing instead of the firing chamber. The sensor can be adjacent the hammer when the attachment is connected with the housing.

The attachment or the housing can be provided with means for determining the duration of emission of radiation by the laser in response to actuation of the trigger when the attachment is connected with the housing. Such determining means can comprise a microchip.

The firearm further comprises at least one energy source for the laser. For example, the housing of the firearm (such as a revolver or a pistol) can have a magazine for one or more clips of ammunition and the at least one energy source is insertable into and withdrawable from such magazine to supply energy to the laser when the attachment is connected with the housing and to be withdrawn from the magazine preparatory to insertion of one or more cliP's of ammunition prior or subsequent to connection of the firing chamber to the housing. It is equally possible to install one or more suitable energy sources directly in the attachment.

The weight of the firing chamber can match or closely approximate the weight of the attachment. Furthermore, the attachment can be provided with a first sight (e.g., the rear sight) which assumes a predetermined position and orientation relative to the housing when the latter is connected with the attachment, and the firing chamber comprises a second sight which assumes the same predetermined position as the first sight when the firing chamber is connected with the housing in lieu of the attachment.

The dimensions of the firing chamber (e.g., a bolt action for use in a carbine or a rifle) can match the dimensions of the attachment. It is further advisable to ensure that the distribution of weight in the attachment at least approximate the distribution of weight in the firing chamber so that the user of the firearm need not discern any difference as far as the balance of the firearm is concerned when the attachment is replaced with the firing chamber or vice versa.

The novel features which are considered as characteristic of the invention are set forth in particular in the appended claims. The improved firearm itself, however, both as to its construction and the mode of converting and using the same, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
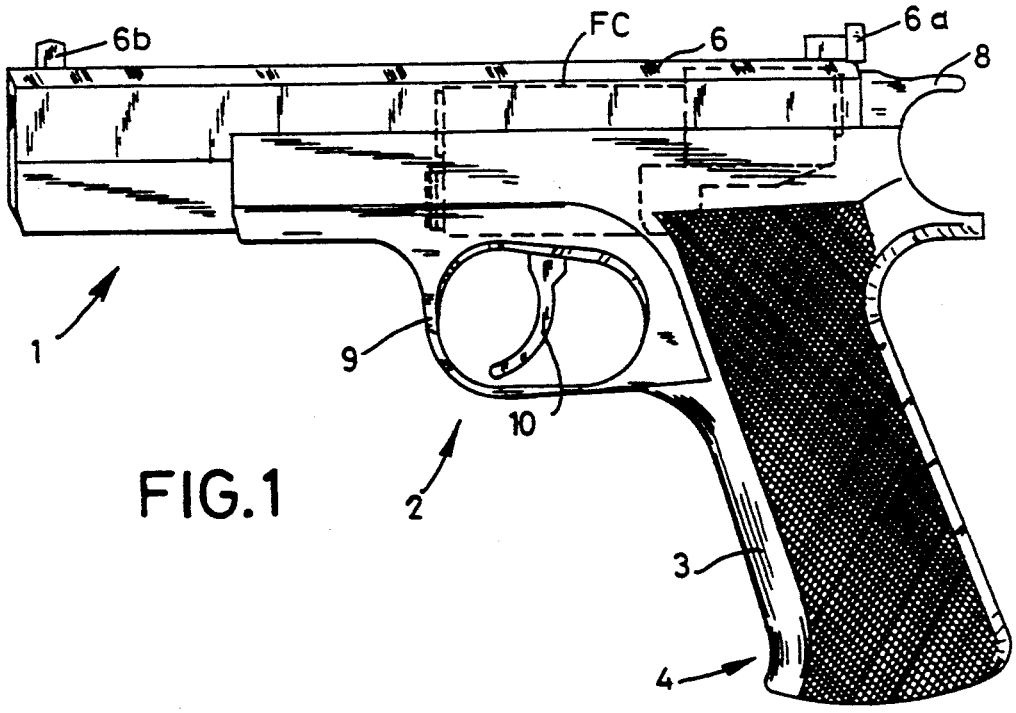
FIG. 1 is an elevational view of a short firearm wherein an essential part is detachable from the horsing to be replaced with an attachment embodying one form of the invention.

FIG. 1 shows a short firearm 1 which has a barrel 6 with a rear sight 6a and front sight 6b and is separably connected to a housing 2 including a hollow grip 3 for a magazine 4 which can receive a clip of cartridges, not shown. The housing 2 carries a trigger 10 which is surrounded by a guard 9 and can be actuated by a finger of the hand holding the grip 3 to cock and release a hammer 8 so that the latter strikes against and fires a cartridge in the barrel 6. The barrel 6 and the housing 2 confine an essential part FC (hereinafter called firing chamber) which receives the foremost or topmost cartridge from the clip in the magazine 4 in a manner which is well known from the art of short firearms and forms no part of the present invention. The same holds true for the design of means for separably coupling the barrel 6 to the housing 2.

Figure 2:
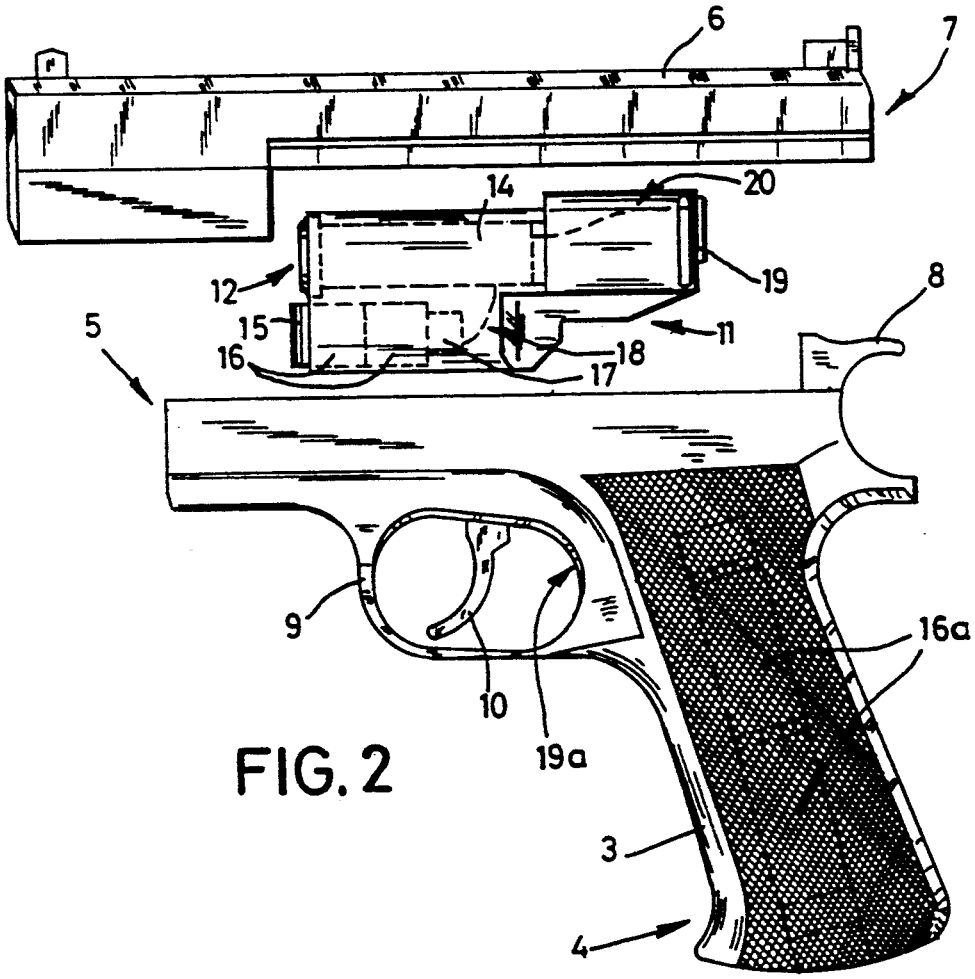
FIG. 2 shows the structure of FIG. 1 but with the essential part disconnected from the housing and further showing the attachment which can be connected to the housing in lieu of the essential part.

FIG. 2 shows a novel attachment 11 which is insertable between the housing 2 and the barrel 6 upon removal of the firing chamber FC. The attachment 11 comprises a conventional laser 14 which can be energized to emit a beam of radiation along a path matching at least the first portion of the path of a bullet issuing from a cartridge which is fired by the hammer 8 when the attachment 11 is replaced with the firing chamber FC. The body of the attachment 11 has an opening 12 for the beam of radiation which issues from the laser 14 when the latter is fired in response to actuation of the trigger 10. The opening 12 is located above a cover 15 for a compartment which is provided in the body of the attachment 11 and serves to receive an energy source for the laser 14 Such energy source can comprise one or more expendable or rechargeable batteries 16. Instead of or in addition to the batteries 16, the energy source for the laser 14 can comprise one or more batteries 16a in the magazine 4. The batteries 16a are insertable into the magazine 4 instead of a clip of live ammunition.

The batteries 16 are connected with and supply electrical energy to a microchip 17 which is installed in the body of the attachment 11 and constitutes or forms part of a means for determining the length of the interval of emission of radiation by the laser 14 in response to actuation of the trigger 10. A conductor 18 serves to supply electrical energy from the microchip 17 to the laser 14.

The rear end portion of the body of the attachment 11 carries a pressure responsive sensor 19 (e.g., a simple normally open electric switch) which is located at the rear end 7 of the barrel 6 (i.e., close to the hammer 8) when the convertible firearm 1 is assembled for the purpose of firing the laser 14 in lieu of live ammunition. The sensor 19 is in circuit with the laser 14 (note the conductor means 20) and serves to complete such circuit so that the laser 14 emits a beam of radiation in response to actuation of the trigger 10, i.e., in response to impingement of the hammer 8 upon the sensor 19. The electric circuit includes the laser 14, the batteries 16a and/or 16, the microchip 17 and the conductor means 18, 20, and this circuit is completed by the switch or sensor 19 in response to actuation of the trigger 10, i.e., when the hammer 8 strikes the switch 19, so that the laser 14 receives electrical energy and emits a beam of radiation through the opening 12. The duration of emission of radiation by the laser 14 is determined by the microchip 17.

The reference character 5 denotes in FIG. 1 an elongated guide which forms part of the housing 2 and serves to determine the position of the barrel 6 after the barrel is reattached to the housing, either to confine the firing chamber FC or to confine the attachment 11.

If the barrel 6 is considered as a component part of the attachment 11 or as a component part of the firing chamber FC, the positions of the rear and front sights 6a, 6b relative to the housing 2 are the same irrespective of whether the housing 2 carries the firing chamber FC or the attachment 11. This ensures that the person using the firearm 1 for target practice is accustomed to the sights 6, 6a since their mutual positions and their positions relative to the housing 2 are the same regardless of whether the housing carries the attachment 11 or the firing chamber FC. The positions of the laser 14 and opening 12 relative to the housing 2 are selected in such a way that the trajectory of the radiation beam issuing from the opening 12 in response to actuation of the trigger 10 is the same as the trajectory of a bullet which leaves the front end of the barrel 6 when the latter confines the firing chamber FC and the operator has squeezed the trigger 10 to fire a cartridge which is then located in the firing chamber FC in front of the hammer 8. The arrangement is preferably such that the trajectory of the beam of radiation coincides at least with the first part of the trajectory of a bullet.

The chip 17 is preferably designed to ensure that the interval of emission of radiation via opening 12 is in the range of one or more minute fractions of one second. This is desirable and advantageous on the ground that the person using the converted firearm 1 for target practice can see the point of impact of the beam of radiation upon a target in spite of the movement of the muzzle of the barrel immediately following actuation of the trigger 10. This enables the operator to visualize the point of impact of a bullet against a target.

It is further within the purview of the invention to transfer the sensor 19 to a location (indicated by arrow 19a in FIG. 2) behind the trigger 10 so that the hammer 8 need not be used as a means for actually completing the circuit of the laser 14, i.e., such circuit is then completed by the trigger 10 which engages the transposed sensor (at the locus indicated by the arrow 19a) before the trigger causes the hammer 8 to strike. An advantage of mounting the sensor 19 at 19a is that the wear upon the movable parts of the converted firearm 1 is greatly reduced because the hammer 8 need not strike a pressure-responsive sensor whenever the operator decides to fire the laser 14.

It is preferred to leave a clip of ammunition in the magazine 4 or to insert the batteries 16a when the firing chamber FC is replaced with the attachment 11 because the weight of the batteries 16a can be selected in such a way that the weight distribution along the firearm 1 is the same when the barrel 6 confines the chamber FC as when the barrel confines the attachment 11. For the same purpose, the weight distribution in the attachment 11 is preferably the same as or similar to that in the firing chamber FC. This also ensures that the "feel" or balance of the firearm 1 in the hand of an operator is the same when the housing 2 carries the chamber FC as when housing carries the attachment 11. Still further, the dimensions of the attachment 11 preferably match or at least closely approximate those of the firing chamber FC. This, combined with the aforediscussed features, even further enhances the value of the improved firearm 1 as an apparatus which can be effectively used for target practice at home, at a firing range or elsewhere.

Since the firearm 1 generates no noise when the firing chamber FC is replaced with the attachment 11 and the trigger 10 is squeezed to complete the circuit of the laser 14, the firearm can be used for target practice at home, e.g., in an apartment in a large apartment building or in any other dwelling which is closely or immediately adjacent other dwellings. Moreover, and since the firearm does not generate noise when it is used to fire the laser 14, such firearm can be used as a practicing implement at all times of the day including late at night.

If the improved attachment 11 is to be used in a revolver, it preferably resembles a cylinder which can be installed behind the barrel as a substitute for a cylinder which can receive live ammunition. The weight of such cylindrical attachment preferably matches or closely approximates the weight of a cylinder for live ammunition so that the person who alternately uses the same firearm as a weapon (e.g., for the purposes of law enforcement or in the armed forces) and for target practice does not detect any differences as far as the weight, the balance and other desirable characteristics of the firearm are concerned. Of course, a cylindrical attachment need not be indexed after each firing of the laser therein; therefore, such cylindrical attachment can be provided with recesses or notches instead of customary, motion receiving parts on a cylinder for live ammunition and can carry a single laser.

Figure 3:
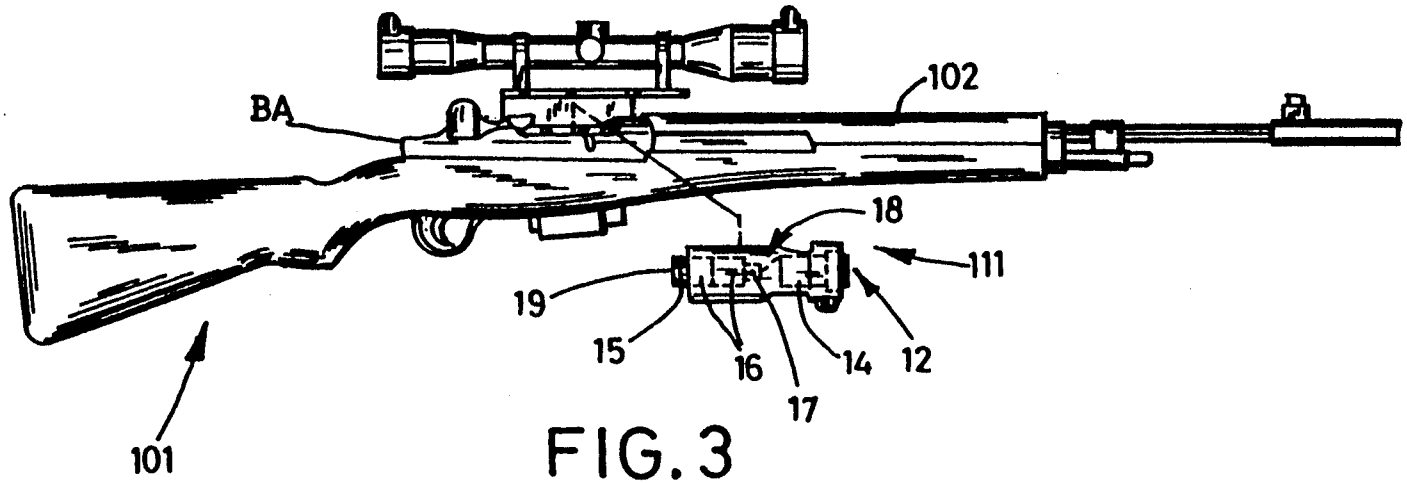
FIG. 3 is an elevational view of a long firearm with the essential part in position and further showing a modified attachment which can replace the essential part.

FIG. 3 shows a long firearm (e.g., a rifle or a carbine wherein an essential part in the form of a bolt action or bolt mechanism BA (hereinafter called firing chamber) can be replaced with a modified attachment 111. The body of the attachment 111 has an opening 12 in front of a laser 14. Two batteries 16 in a compartment behind the laser 14 are confined by a cover 15 which is adjacent a pressure-responsive sensor 19. The latter completes the circuit of the laser 14 when the attachment 111 is installed in the housing 102 of the firearm 101, and the duration of emission of radiation is determined by a microchip 17 which is in circuit with the batteries 16 and the laser 14 (note the conductor means 18). The cover 15 can be omitted if the sensor 19 is used as a lid for the rear end of the compartment for batteries 16.

The firearms 1 and 101 share the feature that they cannot be used to fire live ammunition when the attachment 11 or 111 is properly connected with the housing 2 or 102. Therefore, each of these firearms can be used for practicing at a location away from a firing range. In fact, even if the magazine 4 of the short firearm 1 or the magazine (if any) of the long firearm 101 contains live ammunition, the person using the firearm cannot fire such ammunition as long as the firing chamber FC is replaced with the attachment 11 or as long as the firing chamber BA is replaced with the attachment 111.

Another important advantage of the improved firearm and of the attachment is that the locus of impingement of a laser beam upon a selected target can be detected without resorting to specially designed optical systems which are to be aimed at the target. Certain long firearms are already equipped with optical systems which are trained upon the target to facilitate detection of the point of impact of a bullet or another projectile. The optical systems of such long firearms are provided with means for directing a light beam into them to indicate the point of impact of a projectile against the selected target.

Though the adapter is particularly suited for use in short firearms, its utilization in rifles, carbines and other long firearms brings about at least many of those advantages which are achieved by converting a short firearm for target practice, i.e., for firing of a laser beam instead of live ammunition. Thus, the long firearm can be used at home or at other locations away from a firing range, the utilization of the long firearm for target practice with beams of radiation instead of with bullets does not generate any noise, and the conversion can be completed within a very short interval of time.

If the sensor 19 is positioned to be struck by the hammer 8, the training is even more realistic because the firearm recoils in the same or nearly the same way as if the hammer were to strike a piece of live ammunition in the firing chamber FC or BA.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A firearm comprising a housing; an ammunition-receiving firing chamber detachably connected with said housing; a trigger carried by said housing and actuatable to initiate the discharge of ammunition in said chamber; and an attachment connectable with said housing in lieu of said chamber and comprising a laser operable to emit a beam of radiation and means for operating said laser in response to actuation of said trigger when said attachment is connected with said housing in lieu of said chamber so that ammunition can be discharged in response to actuation of said trigger only when the attachment is disconnected from and said chamber is connected to said housing, the distribution of weight in said attachment at least approximating the distribution of weight in said chamber so that the firearm is balanced at least substantially in the same way when the housing is connected with said chamber and when the housing is connected with said attachment, said chamber having a first sight which assumes a predetermined position with reference to said housing when said chamber is connected to the housing and said attachment having a second sight which assumes said predetermined position when said attachment is connected to said housing.

2. The firearm of claim 1, further comprising a hammer arranged to strike the ammunition in said chamber in response to actuation of said trigger, said attachment including a sensor actuatable to energize said laser upon connection of said attachment to said housing in lieu of said chamber, said sensor being adjacent said hammer when said attachment is connected with said housing.

3. The firearm of claim 1, further comprising means for determining the duration of emission of radiation by said laser in response to actuation cf said trigger when said attachment is connected with said housing in lieu of said chamber.

4. The firearm of claim 3, wherein said determining means includes a microchip.

5. The firearm of claim 1, further comprising at least one energy source for said laser, said housing having a magazine for ammunition and said at least one energy source being insertable into and withdrawable from said magazine.

6. The firearm of claim 1, further comprising at least one energy source for said laser, said at least one energy source being provided in said attachment.

7. The firearm of claim 1, wherein said chamber has a first weight and said attachment has a second weight which at least approximates said first weight.

8. The firearm of claim 1, wherein the dimensions of said attachment at least approximate the dimensions of said chamber.

9. A firearm comprising a housing; an ammunition-receiving firing chamber detachably connected with said housing; a trigger carried by said housing and actuatable to initiate the discharge of ammunition in said chamber; an attachment connectable with said housing in lieu of said chamber and comprising a laser operable to emit a beam of radiation and means for operating said laser in response to actuation of said trigger when said attachment is connected with said housing in lieu of said chamber so that ammunition can be discharged in response to actuation of said trigger only when the attachment is disconnected from and said chamber is connected to said housing, the distribution of weight in said attachment at least approximating the distribution of weight in said chamber so that the firearm is balanced at least substantially in the same way when the housing is connected when said chamber and when the housing is connected with said attachment; and at least one energy source for said laser, said housing having a magazine for ammunition and said at least one energy source being insertable into and withdrawable from said magazine.

10. The firearm of claim 9, further comprising a hammer arranged to strike the ammunition in said chamber in response to actuation of said trigger, said attachment including a sensor actuatable to energize said laser upon connection of said attachment to said housing in lieu of said chamber, said sensor being adjacent said hammer when said attachment is connected with said housing.

11. The firearm of claim 9, further comprising means for determining the duration of emission of radiation by said laser in response to actuation of said trigger when said attachment is connected with said housing in lieu of said chamber.

12. The firearm of claim 11, wherein said determining means includes a microchip.

13. The firearm of claim 9, wherein said at least one energy source is provided in said attachment.

14. The firearm of claim 9, wherein said chamber has a first weight and said attachment has a second weight which at least approximates said first weight.

15. The firearm of claim 9, wherein the dimensions of said attachment a least approximate the dimensions of said chamber.

* * * * *